US007665524B2

(12) United States Patent
DeVault et al.

(10) Patent No.: US 7,665,524 B2
(45) Date of Patent: Feb. 23, 2010

(54) LIQUID METAL HEAT EXCHANGER FOR EFFICIENT HEATING OF SOILS AND GEOLOGIC FORMATIONS

(75) Inventors: Robert C. DeVault, Knoxville, TN (US); David J. Wesolowski, Kingston, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 269 days.

(21) Appl. No.: 11/536,988

(22) Filed: Sep. 29, 2006

(65) Prior Publication Data

US 2008/0078551 A1 Apr. 3, 2008

(51) Int. Cl.
*E21B 36/04* (2006.01)

(52) U.S. Cl. ..... 166/302; 166/60

(58) Field of Classification Search ..... 166/302, 166/303, 266, 272.1, 272.6, 57, 60
See application file for complete search history.

(56) References Cited

U.S. PATENT DOCUMENTS 3,207,220 A * 9/1965 Williams ..... 166/60
3,237,689 A * 3/1966 Justheim ..... 376/275
5,782,301 A 7/1998 Neuroth et al.
5,784,530 A 7/1998 Bridges
6,353,706 B1 3/2002 Bridges
6,742,593 B2 6/2004 Vinegar et al.
6,902,004 B2 6/2005 de Rouffignac et al.
6,929,067 B2 8/2005 Vinegar et al.
7,004,247 B2 2/2006 Cole et al.
7,056,422 B2 6/2006 Dell'Orfano
7,445,041 B2 * 11/2008 O'Brien ..... 166/247
2004/0208495 A1 * 10/2004 Hirano ..... 392/344
2007/0284108 A1 * 12/2007 Roes et al. ..... 166/302

FOREIGN PATENT DOCUMENTS

GB 2409707 6/2005

* cited by examiner

*Primary Examiner*—Daniel P Stephenson
(74) *Attorney, Agent, or Firm*—Joseph A. Marasco

(57) ABSTRACT

Apparatus for efficient heating of subterranean earth includes a well-casing that has an inner wall and an outer wall. A heater is disposed within the inner wall and is operable within a preselected operating temperature range. A heat transfer metal is disposed within the outer wall and without the inner wall, and is characterized by a melting point temperature lower than the preselected operating temperature range and a boiling point temperature higher than the preselected operating temperature range.

11 Claims, 14 Drawing Sheets

LIQUID METAL HEAT EXCHANGER FOR EFFICIENT HEATING OF SOILS AND GEOLOGIC FORMATIONS

STATEMENT REGARDING FEDERALLY SPONSORED RESEARCH

The United States Government has rights in this invention pursuant to contract no. DE-AC 05-00OR22725 between the United States Department of Energy and UT-Battelle, LLC.

BACKGROUND OF THE INVENTION

Various attempts to recover liquid hydrocarbons (oil, kerogen, for example) from geological deposits (oil shale, oil sand, tar sand for example) over the past century have been commercially unsuccessful. One method was to mine and transport the shale to a processing facility, and heat the shale to about 500° C. while adding hydrogen. Energy recovery was inefficient and waste disposal was substantial.

More recently, systems and methods have been devised for down-well heating and extraction of liquid hydrocarbons from oil shale. Lengthy in-ground heat exchanger pipes with electric heating elements heat the oil shale to very high temperatures to drive the hydrocarbons toward another well where they are extracted. A major problem appears to be localized "hot spots" (generally caused by variations in geological formations) that quickly burn out the electric heating elements in the conventional heat exchanger pipe. Devices and methods are needed to mitigate hot spots and to provide more efficient heat transfer from a heater to a subterranean earth (soil or geologic formation, for example). Another potential application of such a device would be in situ remediation of organic-contaminated soils and geologic formations by thermal decomposition.

Specifically referenced and incorporated herein by reference in their entirety are the following U.S. patents:

U.S. Pat. No. 5,782,301 issued on Jul. 21, 1998 to Neuroth et al. entitled "Oil Well Heater Cable "

U.S. Pat. No. 5,784,530 issued on Jul. 21, 1998 to Bridges entitled "Iterated Electrodes for Oil Wells".

U.S. Pat. No. 6,353,706 issued on Mar. 5, 2002 to Bridges entitled "Optimum Oil-Well Casing Heating".

U.S. Pat. No. 6,742,593 issued on Jun. 1, 2004 to Vinegar et al. entitled "In Situ Thermal Processing of a Hydrocarbon Containing Formation Using Heat Transfer from a Heat Transfer Fluid to Heat the Formation".

U.S. Pat. No. 6,902,004 issued on Jun. 7, 2005 to De Rouffignac et al. entitled "In Situ Thermal Processing of a Hydrocarbon Containing Formation Using a Movable Heating Element".

U.S. Pat. No. 6,929,067 issued on Aug. 16, 2005 to Vinegar et al. entitled "Heat Sources with Conductive Material for In Situ Thermal Processing of an Oil Shale Formation".

U.S. Pat. No. 7,004,247 issued on Feb. 28, 2006 to Cole et al. entitled "Conductor-In-Conduit Heat Sources for In Situ Thermal Processing of an Oil Shale Formation".

U.S. Pat. No. 7,056,422 issued on Jun. 6, 2006 to Dell'Orfano entitled "Batch Thermolytic Distillation of Carbonaceous Material".

Also referenced as additional background material, but not incorporated herein is Great Britain Pat. No. 2,409,707 issued on Jun. 7, 2005 to Noel Alfred Warner entitled "Liquid Metal Heat Recovery in a Gas turbine Power System".

BRIEF SUMMARY OF THE INVENTION

In accordance with one aspect of the present invention, the foregoing and other objectsare achieved by apparatus for efficient heating of subterranean earth, which includes a well-casing that has an inner wall and an outer wall. A heater is disposed within the inner wall and is operable within a preselected operating temperature range. A heat transfer metal is disposed within the outer wall and without the inner wall, and is characterized by a melting point temperature lower than the preselected operating temperature range and a boiling point temperature higher than the preselected operating temperature range.

In accordance with another aspect of the present invention, a method of heating subterranean earth includes the steps of disposing the well-casing described above into a well and operating the heater within the preselected operating temperature range to raise the temperature of the heat transfer metal to at least one temperature within the preselected operating temperature range to transfer heat from the heater to the subterranean earth.

Figure 1:
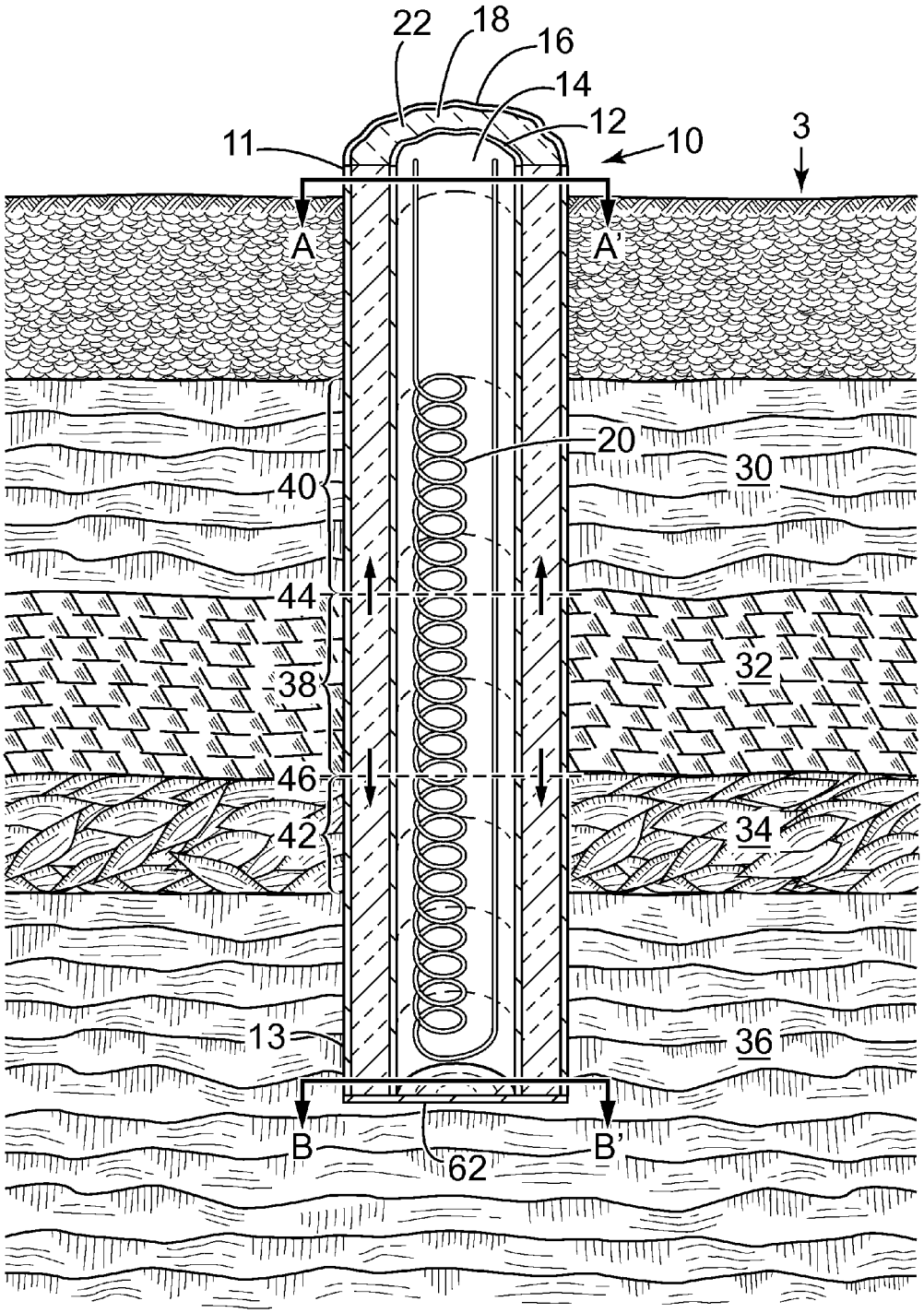
FIG. 1 is a schematic, not-to-scale, partial cutaway view of a down-hole apparatus for heating subterranean earth in accordance with various embodiments of the present invention.

The drawings are of a simple, schematic fashion, and are intended to aid the skilled artisan in the practice of the invention without including superfluous details or features. For a better understanding of the present invention, together with other and further objects, advantages and capabilities thereof, reference is made to the following disclosure and appended claims in connection with the above-described drawings.

DETAILED DESCRIPTION OF THE INVENTION

Uniform heating of subterranean earth (soils and geologic formations, for example) in order, for example, to extract hydrocarbons, without creating hot spots, might be achieved using a conventional heat transfer fluid such as a glycol, therminol, or oils, for example, to eliminate hot spots (principally through high thermal conductivity, rapid convective heat transfer within the fluid, etc.). In some cases, particularly that of oil shale, because of the very high temperatures involved, conventional heat transfer fluids would be unlikely to work. The use of liquid metals as high temperature heat transfer fluids would substantially eliminate the hot spots that would occur while using liquid metal materials that could easily operate at the very high temperatures needed for the oil shale and similar applications, such as subsurface remediation of organic contaminants by thermal decomposition. Liquid metals provide benefits as a heat transfer fluid compared to conventional practice.

Apparatus in accordance with the present invention includes a heater, which can be any conventional means for producing heat energy suitable for transfer to a geologic formation or soil. The particular heater that may be employed is not critical to the present invention. The heater should be operable at a suitable, preselectable (including unregulated, but generally known) temperature range.

A critical aspect of the present invention is the use of liquid metal to transfer the heat to the subterranean earth. Candidate liquid metals include metallic elements and alloys that are generally characterized by a melting point temperature lower than the preselected operating temperature range of the heater, and a boiling point temperature higher than the preselected operating temperature range of the heater.

Moreover, various other factors may affect the selection of a suitable liquid metal heat transfer fluid. It is preferable that a liquid metal be characterized by low toxicity and low chemical reactivity. Suggested heat exchange metals include, but are not limited to sodium, potassium, bismuth, lead, tin, antimony, and alloys of any of the foregoing. Table 1 provides data for several selected candidate metals.

TABLE 1

| | Element(s) | | | | | |
|---|---|---|---|---|---|---|
| | Sodium | Potassium | Bismuth | Lead | Lead (44.5%) Bismuth (55.5%) | Tin |
| Atomic Number | 11 | 19 | 83 | 82 | — | 50 |
| Atomic Weight | 22.997 | 39.0983 | 209 | 207.21 | — | 118.7 |
| Density ($Kg/M^3j$) | 970 | 860 | 9800 | 10700 | 10200 | 7000 |
| Melting Point (° C.) | 98 | 63 | 271 | 327.4 | 123.5 | 231.8 |
| Boiling Point (° C.) | 892 | 759 | 1560 | 1737 | 1670 | 2270 |
| Toxicity | High | High | Slight | High | High | Insignificant |
| Chemical Reactivity | High | High | Slight | Moderate (as dust) | Moderate (as dust) | Slight (as dust) |

As an example, in the case where tin is used as the heat transfer medium, the heater will be operated at a temperature or in a temperature range above 231.8° C. and below 2270° C. Tin is a particularly attractive candidate metal because of its negligible toxicity and reactivity, and low cost.

Figure 2:
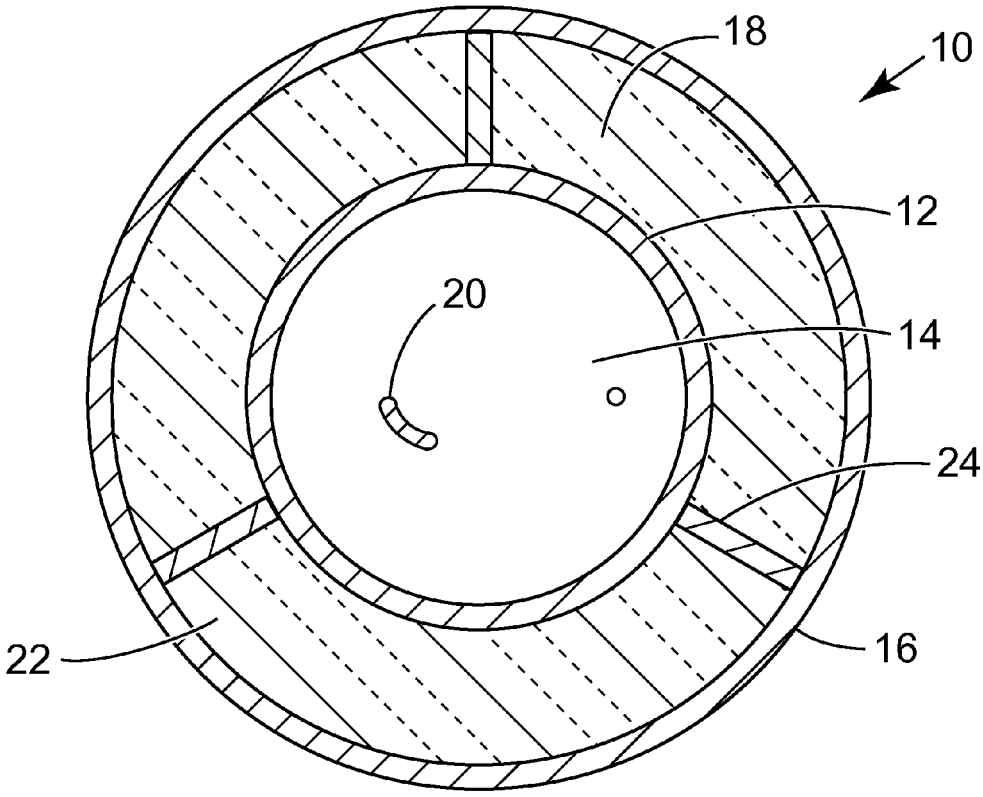
FIG. 2 is a section through A-A' of FIG. 1 in accordance with an embodiment of the present invention.

Referring to FIGS. 1, 2, a down-hole apparatus in accordance with an embodiment of the present invention generally comprises a well-casing 10 or a structural and/or functional equivalent thereof having an inner wall 12 that defines an inner compartment (core) 14, and an outer wall 16, defining an outer compartment (jacket) 18. The core 14 houses an electrically resistive heating element 20, and the jacket 18 contains a heat transfer metal 22 that is in the liquid (molten) state during operation. In the present invention, at least a portion of the heat transfer metal 22 is necessarily contained in a container configured for down-hole insertion, generally a well-casing, a structural and/or functional equivalent thereof, and/or a compartment of either of the foregoing.

A plurality of axial supports 24 disposed in the jacket 18 are fastened to the inner wall 12 and the outer wall 16 to provide support and keep the inner wall 12 and the outer wall 16 separated. The axial supports 24 can be continuous, segmented, perforated, or otherwise configured. Three supports 24 as shown in FIG. 2 are generally considered the practical minimum for stability and strength. A bottom plate 62 serves as a terminus of the well-casing 10, sealing off the bottom of the core 14 and the jacket 18. The shape and configuration of the bottom plate 62 is not critical to the invention.

The circumferential thickness of the jacket 18 can vary widely—from paper-thin to several inches—and can be generally directly proportional to the non-uniformity and thermal characteristics of the subterranean earth 3 being heated.

FIG. 1 is a general exemplary illustration showing that the well-casing 10 penetrates subterranean earth 3, which includes various geological strata 30, 32, 34, 36, each stratum having a different heat transfer characteristic, causing a hot spot 38 as heat is transferred from the well-casing 10 to the geological deposit 3. A hot spot 38 could, in conventional apparatus, result in overheating and failure of the resistive heating element 20. However, in accordance with the present invention, the molten heat transfer metal 22 will reduce the temperature differential between the hot spot 38 and the surrounding regions 40, 42 (respectively above and/or below the hot spot) by heat transfer (generally via conduction and/or convection), shown by respective arrows 44, 46. As the temperature of the hot spot 38 rises, the rate of heat transfer rises to a point where equilibrium is reached, and the temperature of the hot spot 38 rises no further. Thus, in the presently described embodiment, the hot spot is not altogether eliminated, but rather minimized. Thus, an advantage of the invention is that temperatures of hot spots are maintained at within the operable range of the resistive heating element 20.

Figure 3:
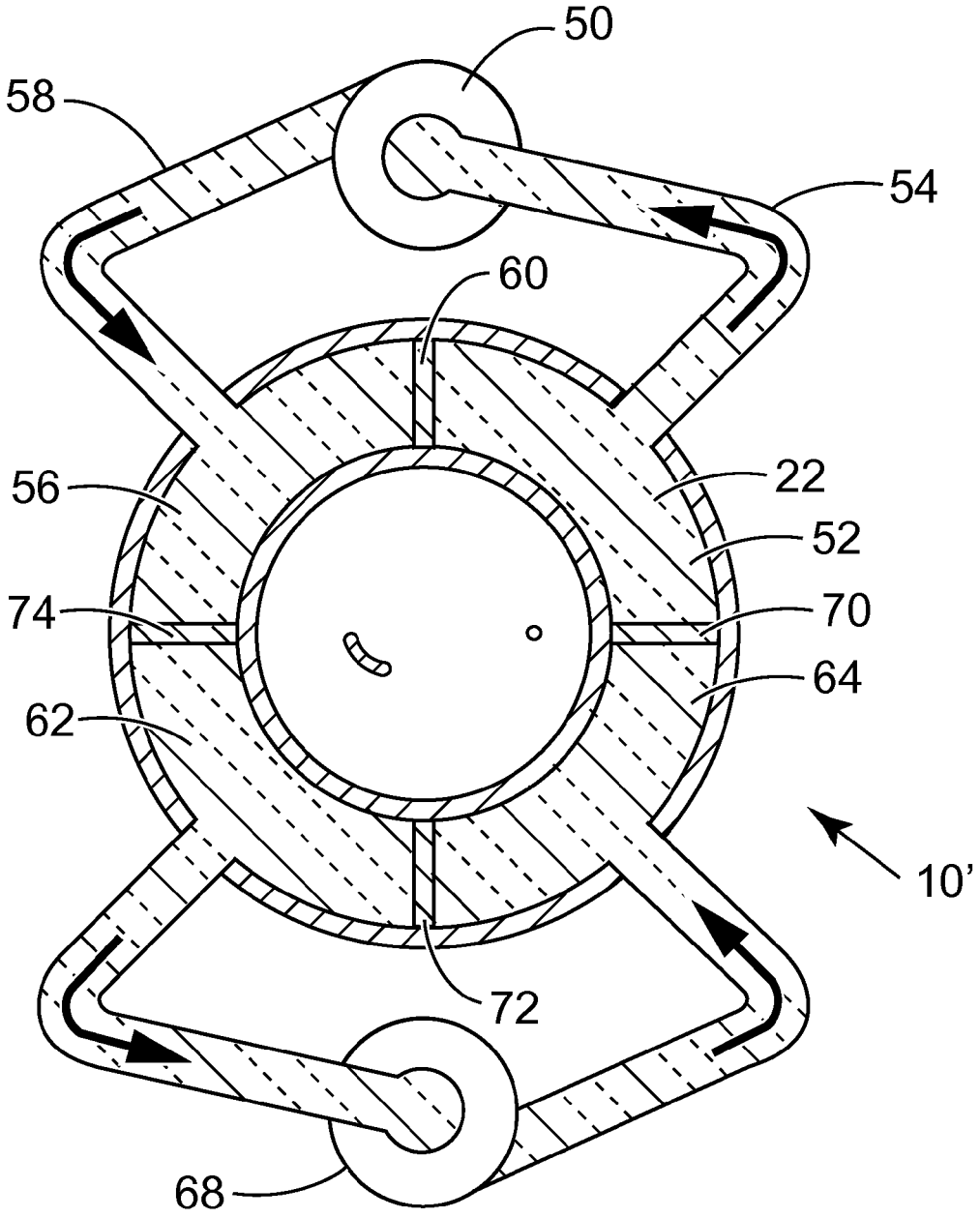
FIG. 3 is a section through A-A' of FIG. 1 in accordance with various other embodiments of the present invention.
Figure 4:
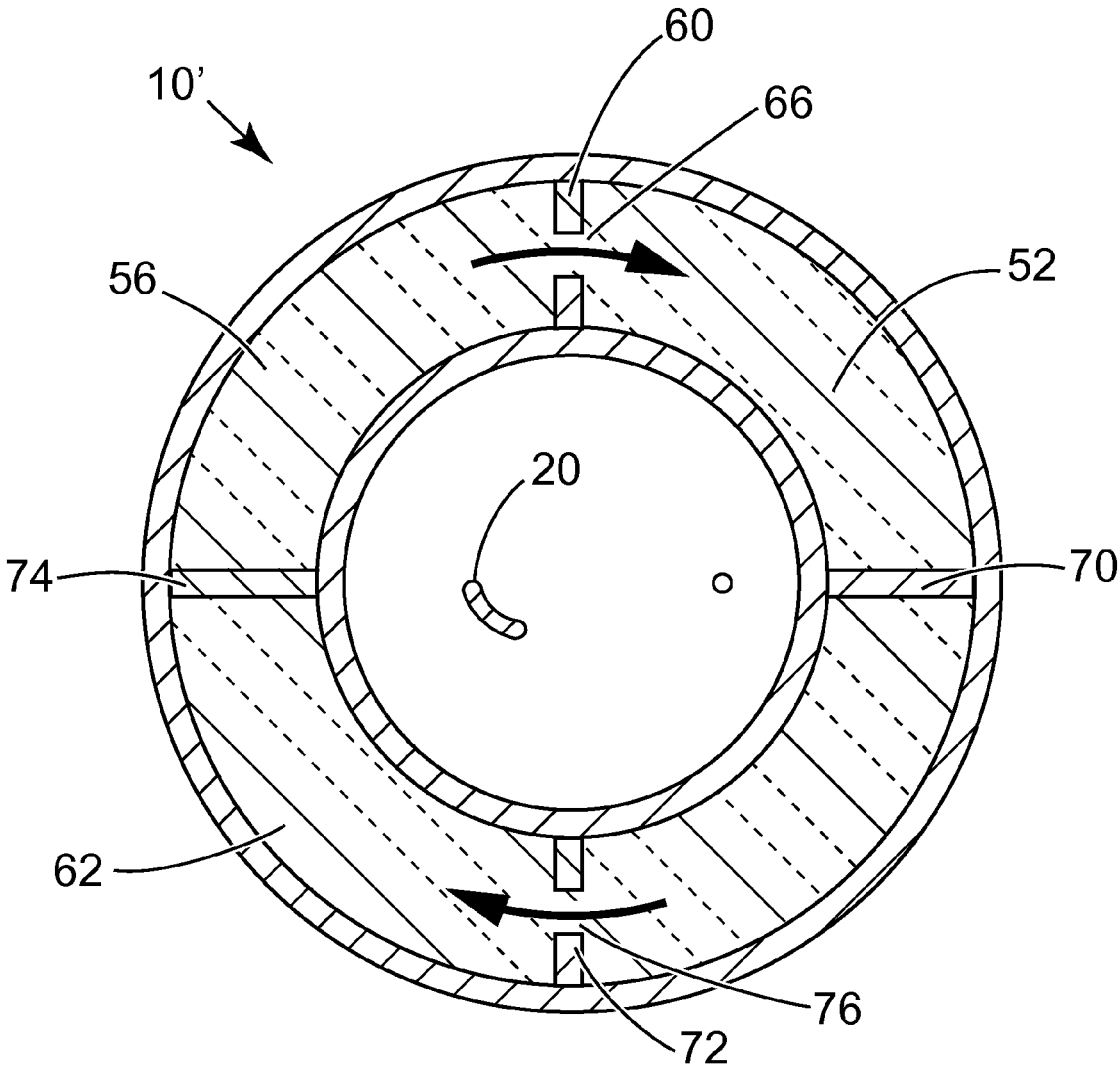
FIG. 4 is a section through B-B' of FIG. 1 in accordance with some of the embodiments of the present invention shown in FIG. 3.

In some embodiments of the invention, hot spots can be further minimized or completely eliminated by adding a means for forcibly circulating the molten heat transfer metal 22 throughout the jacket 18. FIGS. 3, 4 show an embodiment of the present invention where there is an even number of axial supports 60, 70, 72, 74 disposed in the jacket 18 to define an even number of segments 52, 56, 62, 64 to facilitate generally equal axial flow rates in two directions.

Pumps 50, 68 located generally at the top portion 11 of the apparatus 10 are design to impel molten heat transfer metal 22 at the operating temperature. Both pumps 50, 68 operate in the same manner. One pump 50 draws the molten heat transfer metal 22 from a segment 52 of the jacket 18 via a connection 54 and expels the molten heat transfer metal 22 into another segment 56 of the jacket 18 via another connection 58. One or a plurality of pumps may be used. Pump(s) my be located outside, inside, above, or otherwise suitably disposed relative to the down-hole apparatus.

As shown in FIG. 4, the axial support 60 between the two segments 52, 56, can have an opening 66 at the bottom portion 13 of the apparatus 10 to facilitate circulation of the molten heat transfer metal 22 from jacket segment 56 to jacket segment 52. Any communication between the jacket segments 56, 52, including modification to the inner wall 12, the outer wall 16, and/or the bottom plate 62 can also facilitate circulation of the molten heat transfer metal 22 up and down the length of the apparatus 10. The remaining jacket segments 62, 64, are comparably configured and equipped, using the second pump 68 and opening 76 in axial support 72. In this embodiment, the remaining two axial supports 70, 74 do not need to be modified; there are two discrete molten metal circuits.

Figure 5:
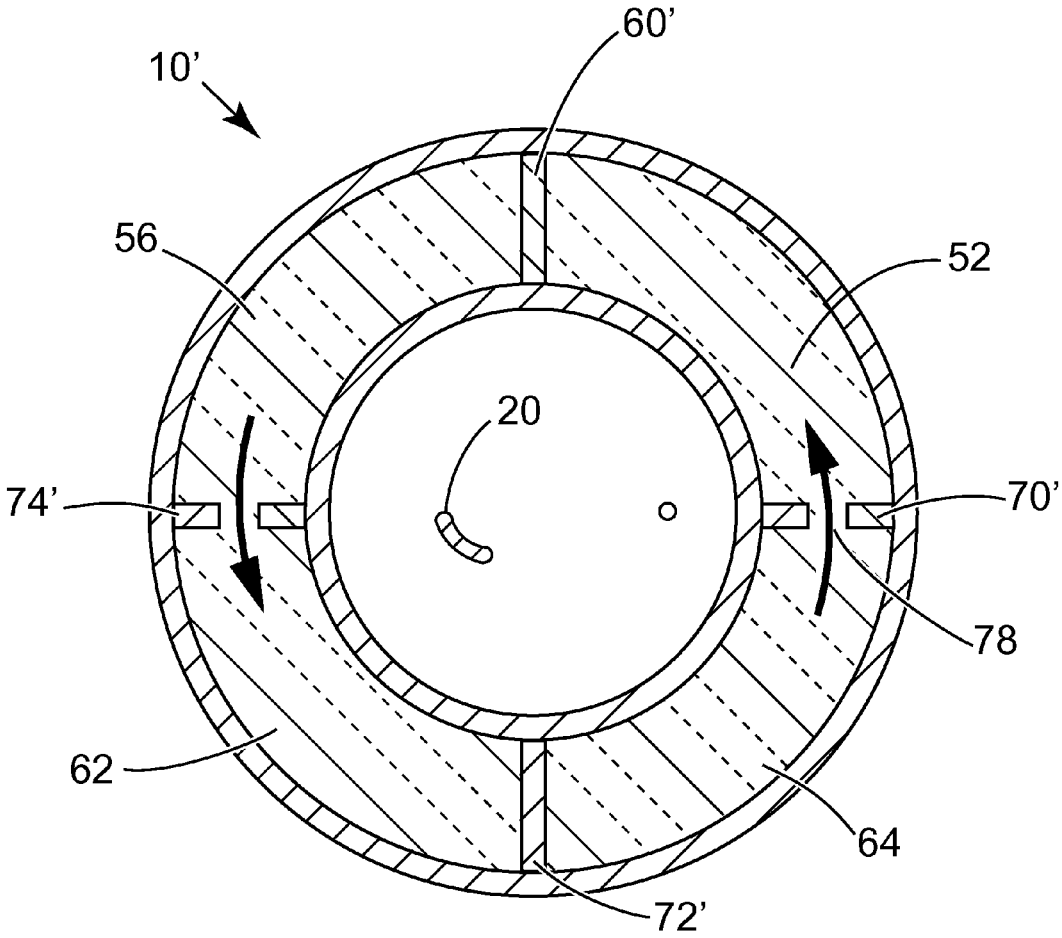
FIG. 5 is a section through B-B' of FIG. 1 in accordance with other of the embodiments of the present invention shown in FIG. 3.

Referring to FIG. 5, another embodiment of the invention has a single discrete molten metal circuit. The top portion 11 of the apparatus 10 is essentially the same as in FIG. 3. The axial supports 60', 72' have no openings at the bottom portion 13 of the apparatus 10. The other two axial supports 70', 74' have respective openings 78, 80 at the bottom portion 13 of the apparatus 10. Flow from one pump 50 enters segment 56, travels down the apparatus 10, through opening 80 into segment 62, up and through the second pump 68 into segment 64, down and through opening 78 into segment 52, and back up and through pump 50.

Figure 6:
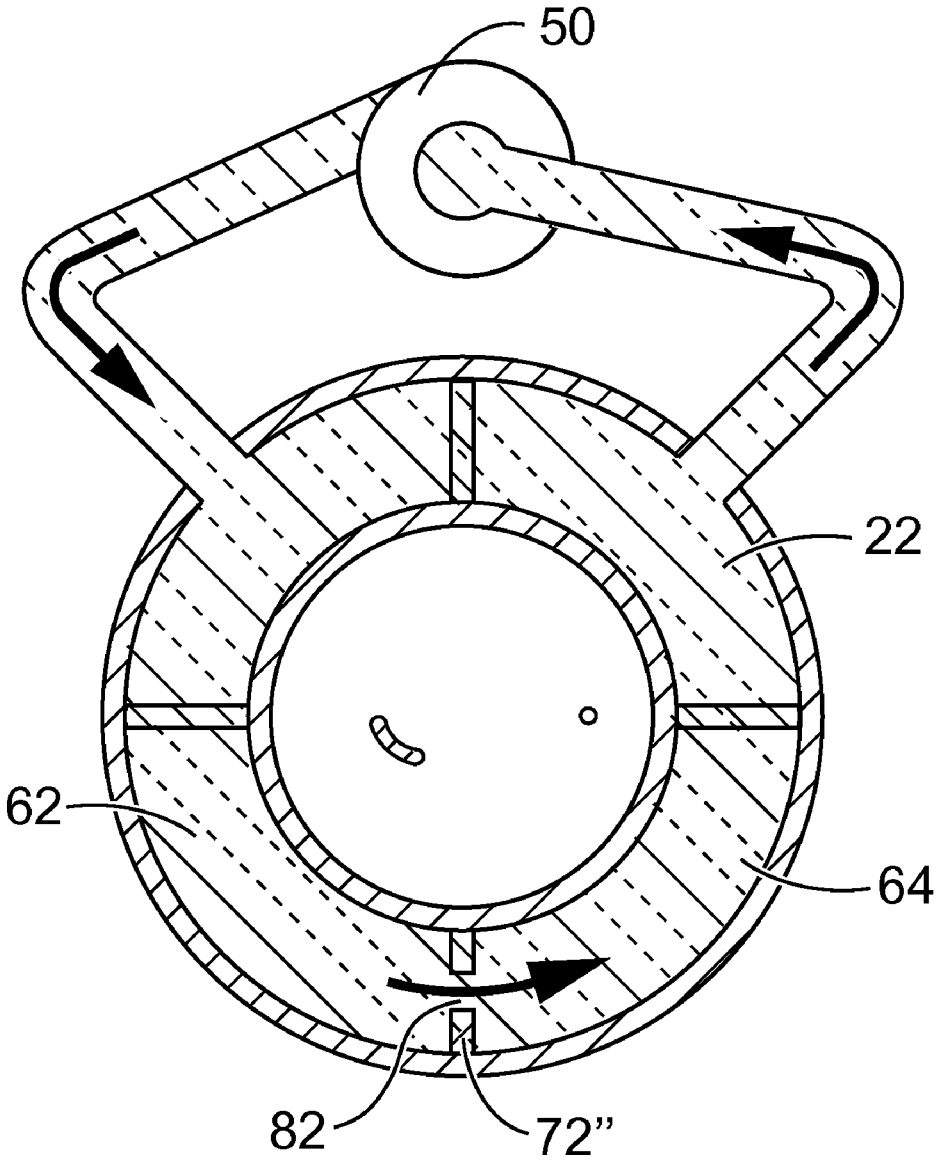
FIG. 6 is a section through A-A' of FIG. 1 in accordance with various other embodiments of the present invention.

FIG. 6 shows a variation of the embodiment having single discrete molten metal circuit described hereinabove and shown in FIGS. 3, 5. The second pump 68 shown in FIG. 3 has been replaced with an opening 82 in axial support 72". Circulation of circulation of the molten heat transfer metal 22 is effected by a single pump 50.

Figure 7:
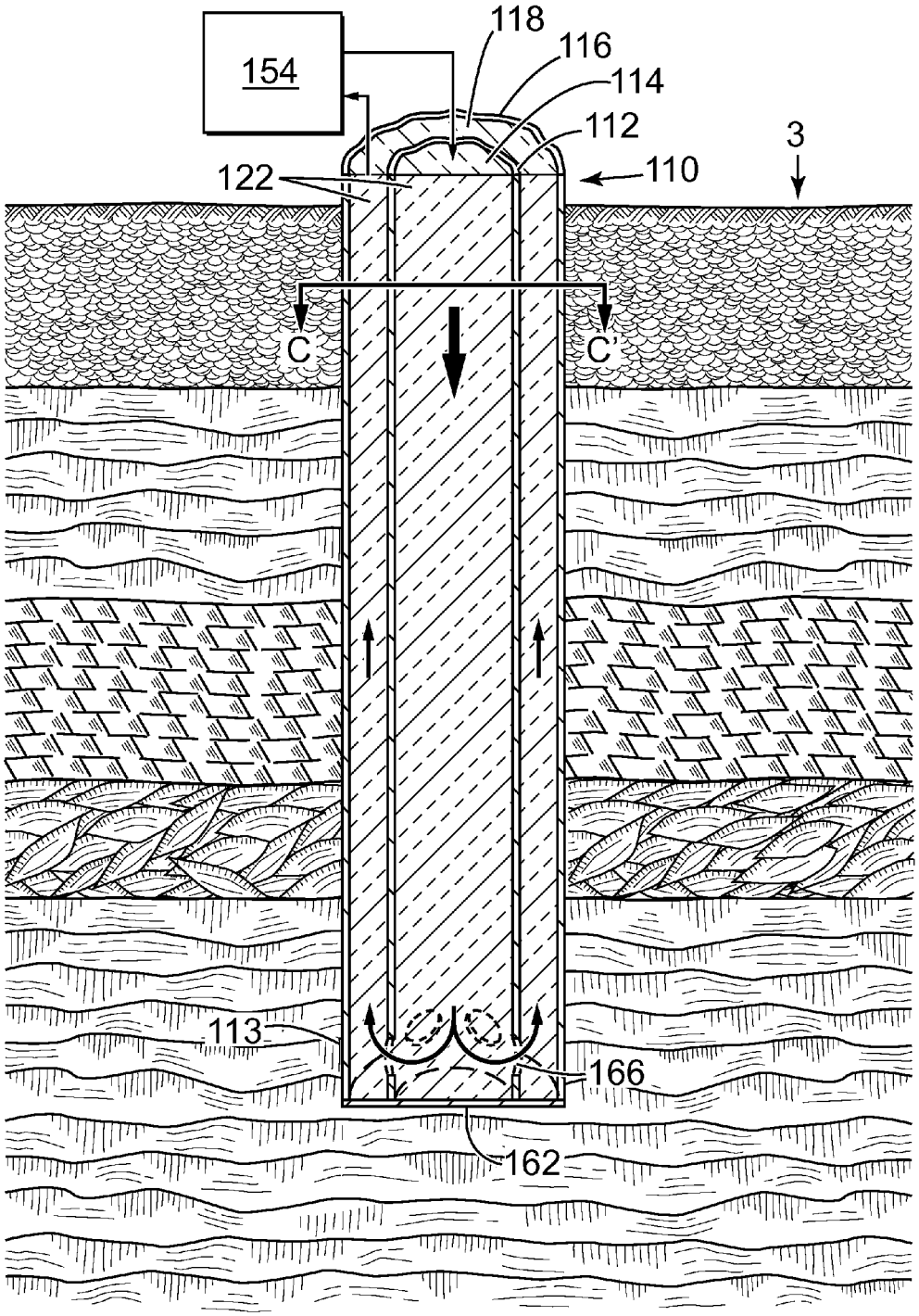
FIG. 7 is a schematic, not-to-scale, partial cutaway view of a down-hole apparatus for heating subterranean earth in accordance with various other embodiments of the present invention.
Figure 8:
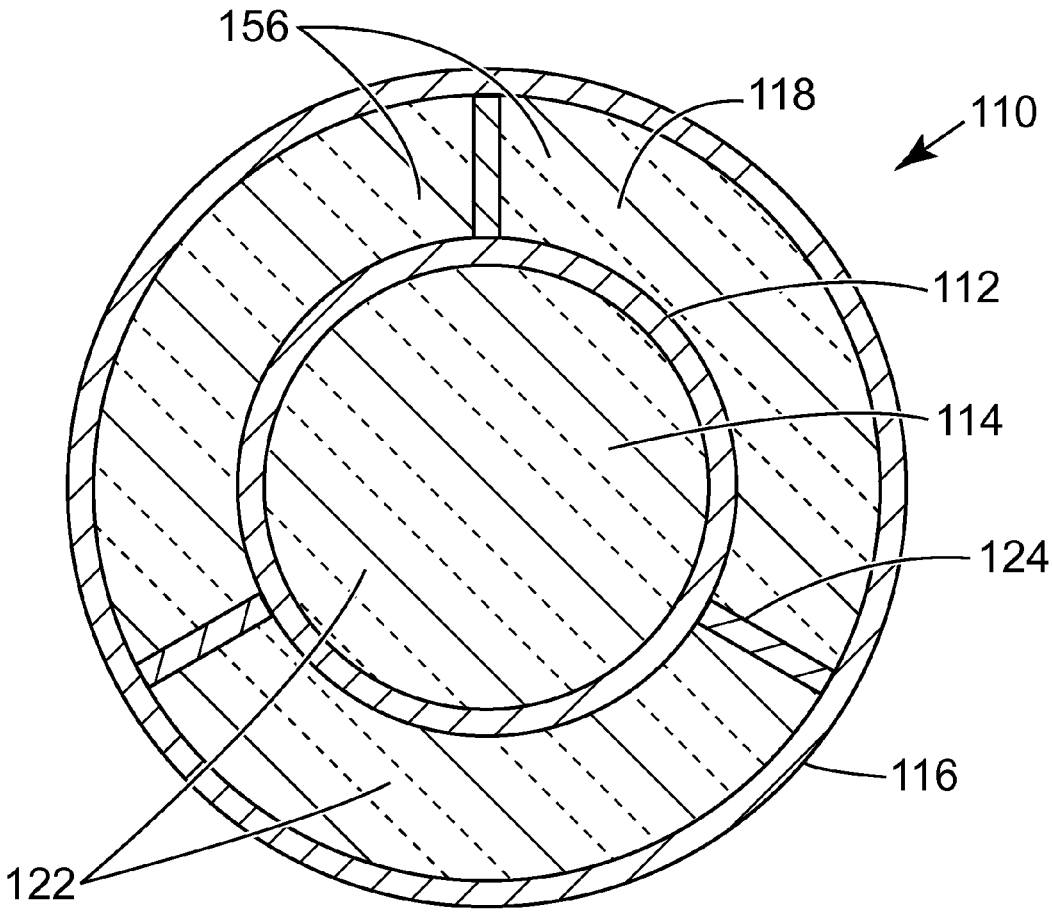
FIG. 8 is a section through C-C' of FIG. 5 in accordance with an embodiment of the present invention.

FIGS. 7, 8 show a different embodiment of the invention that includes, as described hereinabove, a well-casing 110 having an inner wall 112 that defines an inner compartment (core) 114, and an outer wall 116, defining an outer compartment (jacket) 118. The core 114 and the jacket 118 confines a heat transfer metal 122 that is in the liquid (molten) state during operation. A plurality of axial supports 124 disposed in the jacket 118 are fastened to the inner wall 112 and the outer wall 116 to provide support and keep the inner wall 112 and the outer wall 116 separated. A bottom plate 162 serves as a terminus of the well-casing 110. The shape and configuration of the bottom plate 162 is not critical to the invention.

The inner wall 112 has at least one opening 166 at or near the bottom portion 113 of the apparatus 110 to facilitate circulation of the molten heat transfer metal 122 from the core 114 to each segment of 156 of the jacket 118 or vice versa. As shown by the arrows, an external heating and pumping facility 154 heats the heat transfer metal 122 to the desired temperature and forces the heat transfer metal 122 into the core 114. The heat transfer metal 122 travels down through the core to the bottom portion 113, through the openings 166, and back up through the jacket 118 where it is returned to the external heating and pumping facility 154 while transferring the heat to the geological deposit 3. The external heating and pumping facility 154 can be an electrical resistance heater, a combustor, solar collector, or any other known type of heat generating device.

Figure 9:
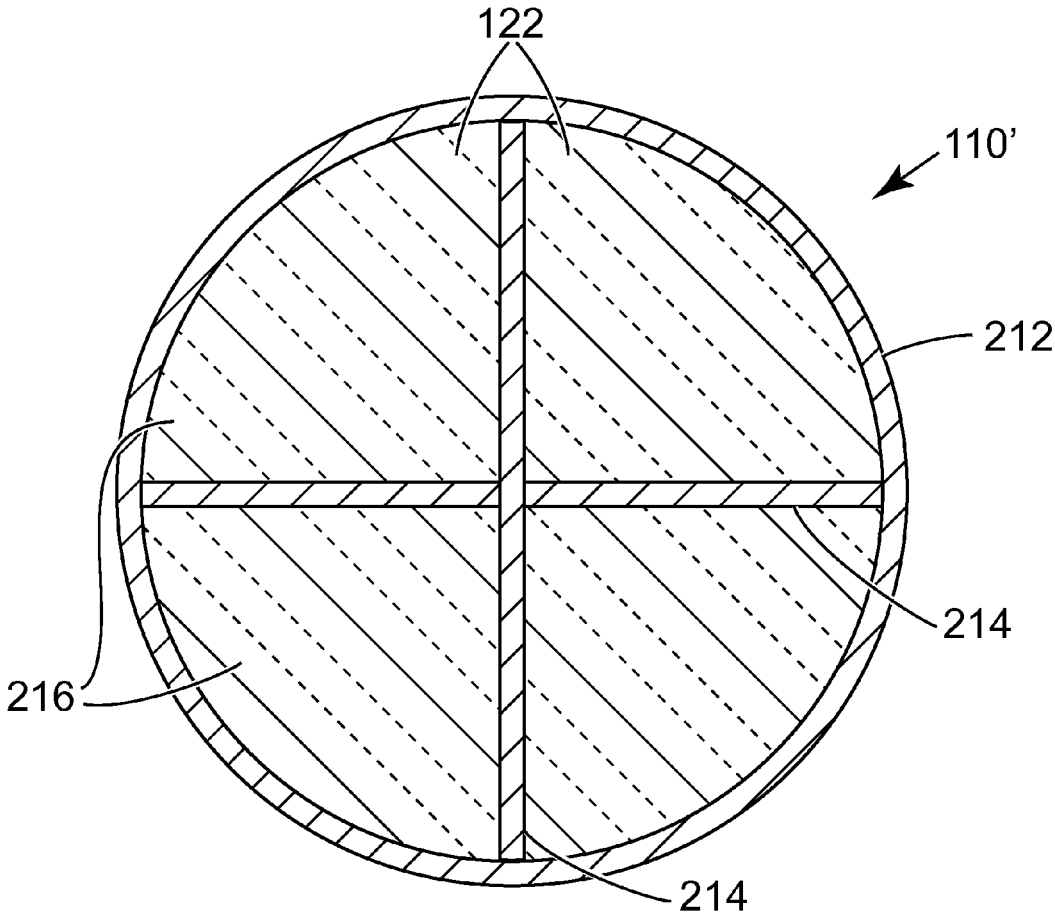
FIG. 9 is a schematic, not-to-scale, sectional view of an embodiment of the present invention.

FIG. 9 shows an embodiment of the invention that is closely related to the embodiment described in connection with FIGS. 7, 8. Instead of using a double-wall casing, the apparatus 110' uses a single-wall casing 212. Axial dividers 214 divide the casing 212 into an even number of segments 216. An external heating and pumping facility 154 (shown in FIG. 7) heats the heat transfer metal 122 to the desired temperature and forces the heat transfer metal 122 into half of the segments 216. The heat transfer metal 122 it is returned to the external heating and pumping facility 154 via the other half of the segments 216.

Figure 10:
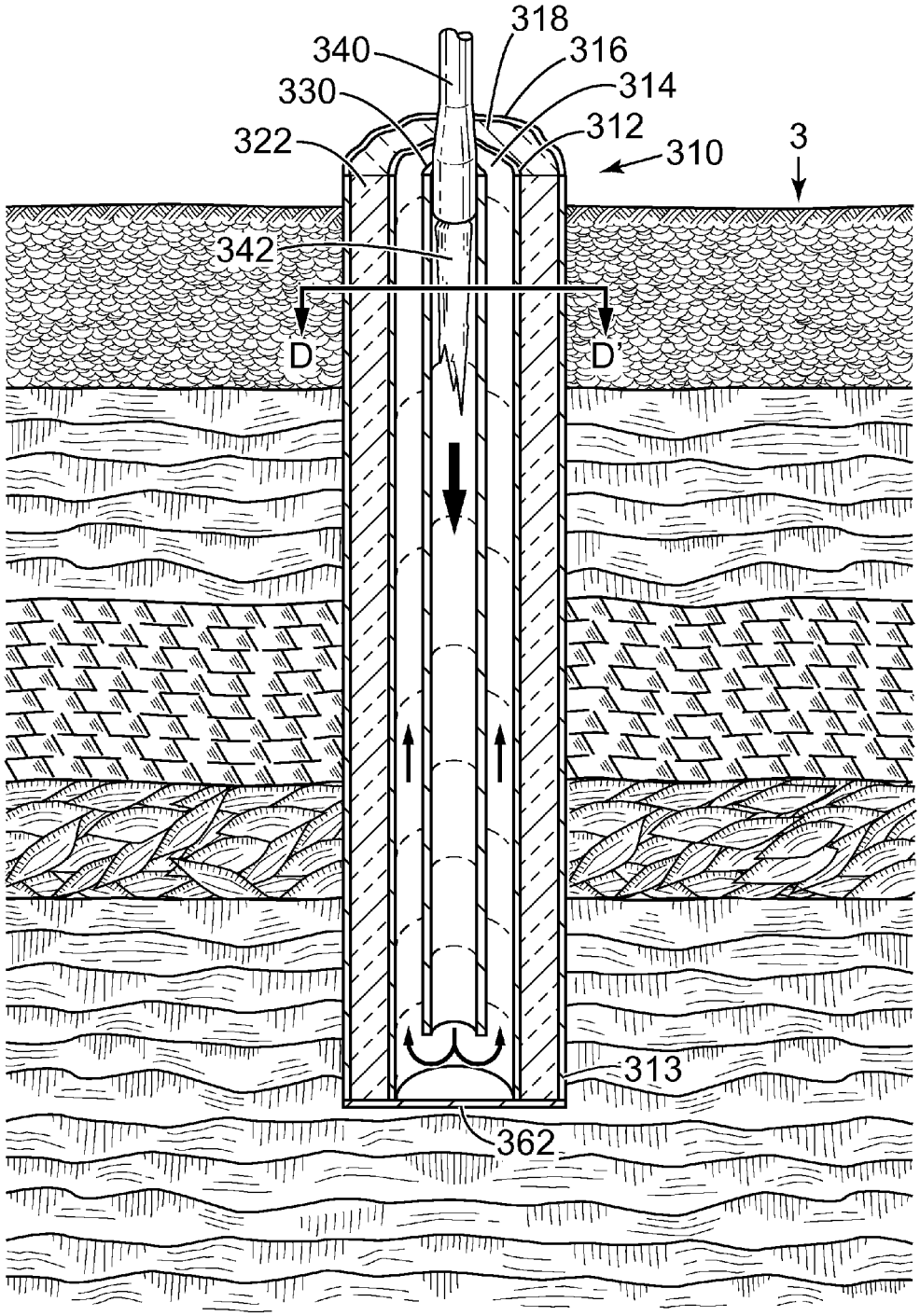
FIG. 10 is a schematic, not-to-scale, partial cutaway view of a down-hole apparatus for heating subterranean earth in accordance with various other embodiments of the present invention.
Figure 11:
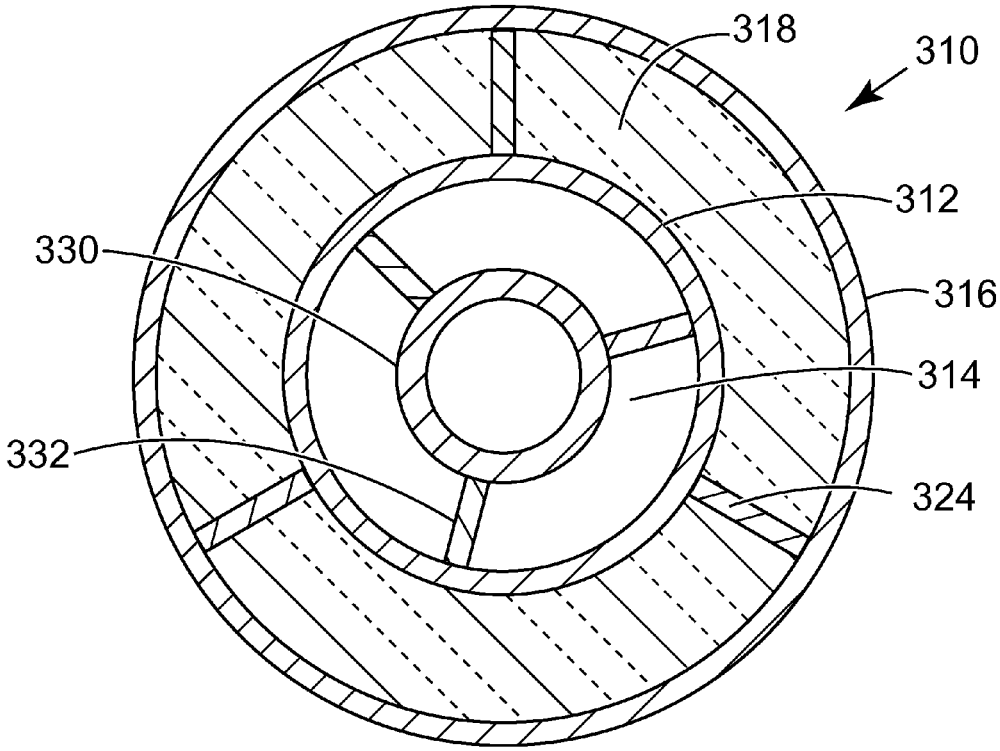
FIG. 11 is a section through D-D' of FIG. 7 in accordance with an embodiment of the present invention.

FIGS. 10, 11 show a different embodiment of the invention that uses a down-hole combustor as the heat source. The apparatus includes a well-casing 310 having an inner wall 312 that defines an inner compartment (core) 314, and an outer wall 316, defining an outer compartment (jacket) 318. The jacket 318 confines a heat transfer metal 322 that is in the liquid (molten) state during operation. A plurality of axial supports 324 disposed in the jacket 318 are fastened to the inner wall 312 and the outer wall 316 to provide support and keep the inner wall 312 and the outer wall 316 separated. A bottom plate 362 serves as a terminus of the well-casing 310. The shape and configuration of the bottom plate 362 is not critical to the invention. This part of the embodiment can be modified as shown in FIGS. 3, 4, 5.

The apparatus further includes a combustion tube 330 that extends to the bottom portion 313 thereof. A plurality of combustion tube supports 332 disposed in the core 314 are fastened to the inner wall 312 and the combustion tube 330 to provide support and keep the inner wall 312 and the combustion tube 330 separated. The combustion tube supports 332 can be axial, radial, planar, helical, continuous, segmented, perforated, or otherwise configured as desired.

A combustion head 340 directs a flame or combustion mix 342 down the combustion tube. Hot gases travel in the direction of the arrows, reach the bottom portion 313, enter the core 314, and travel up the core 314, heating the heat transfer metal 322, which transfers the heat to the geological deposit 3. Multiple combustion heads 340 may be positioned around and/or down the combustion tube 330. Flameless combustor (s) and/or radiant combustor surface(s) (not illustrated) may be used.

Figure 12:
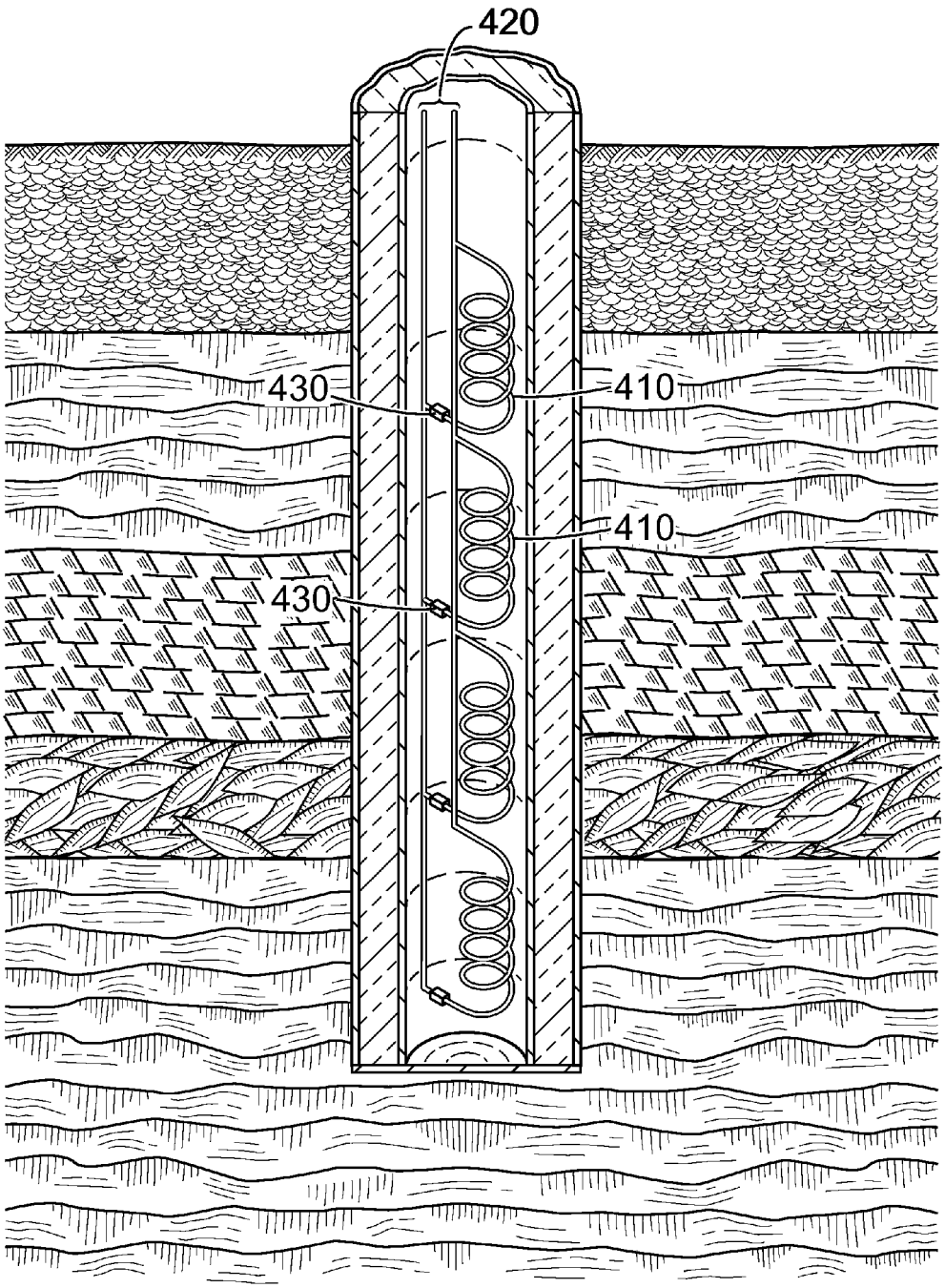
FIG. 12 is a schematic, not-to-scale, partial cutaway view of a down-hole apparatus for heating subterranean earth in accordance with various embodiments of the present invention.

A modification of some of the embodiments described hereinabove is shown in FIG. 12, which is similar to FIG. 1 with the exception of the heat source. The heat source is provided by discrete heating elements 410 arranged in a vertical array and connected in parallel electrical circuit 420. Each of the heating elements 410 is controlled by its own thermostat 430, providing extra protection against hot spots.

Figure 13:
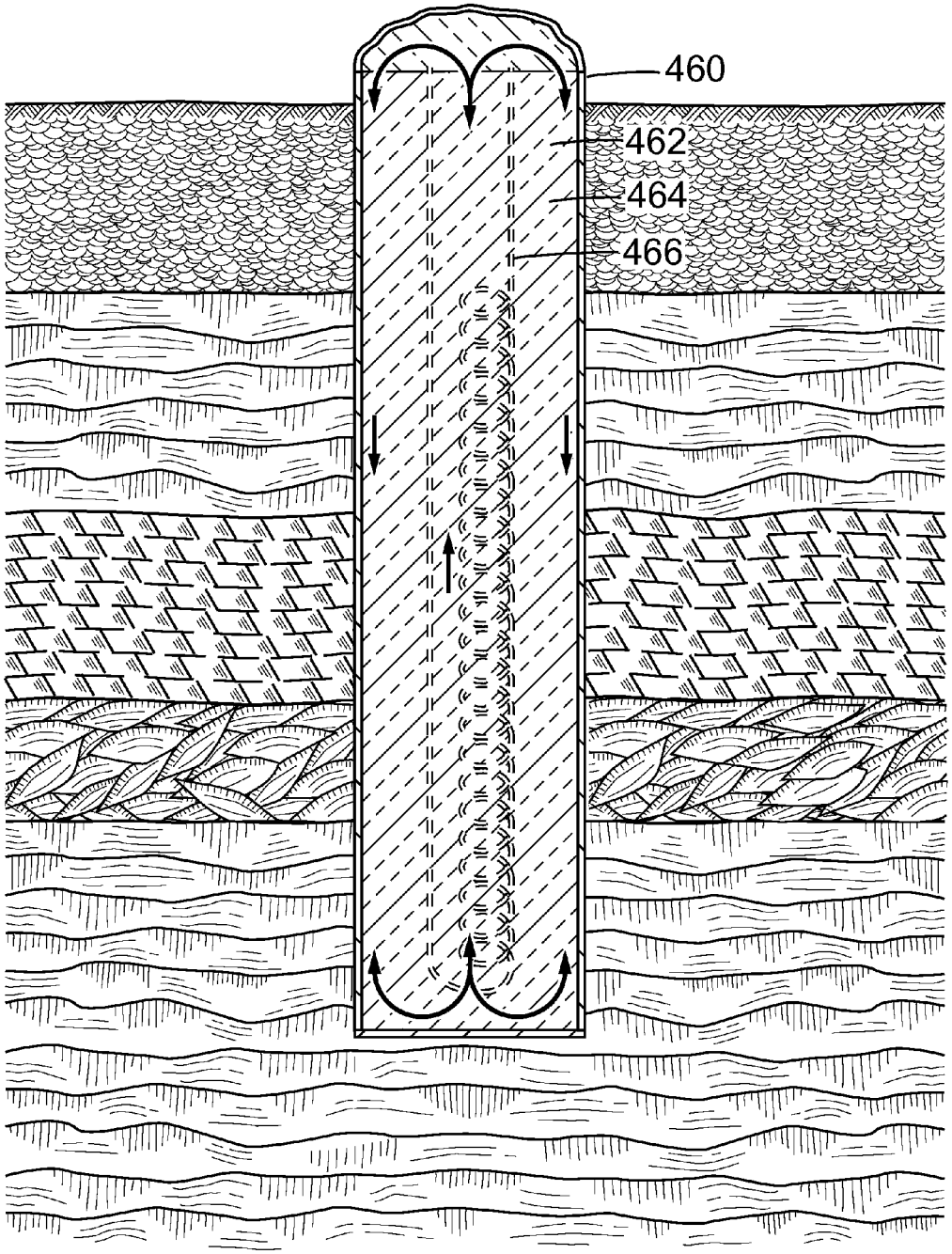
FIG. 13 is a schematic, not-to-scale, partial cutaway view of a down-hole apparatus for heating subterranean earth in accordance with various embodiments of the present invention.

A simple embodiment of the present invention is shown in FIG. 13. A well casing 460 comprises a single internal compartment 462 containing molten heat transfer metal 464. A heating element 466 is immersed within and in direct contact with the heat transfer metal 464. Therefore, the heating element 466 must be electrically insulated from the heat transfer metal 464. During operation, heat transfer metal 464 in the immediate vicinity of the heating element 466 will reach higher temperatures than the heat transfer metal 464 the immediate vicinity of the well casing 460, driving convective circulation of the molten heat transfer metal 464 upward the immediate vicinity of heating element 466 and downward the immediate vicinity of the well casing 460 as shown by the arrows, maximizing heat transfer from the heating element 466 to the well casing 460 and minimizing hot spots.

Figure 14:
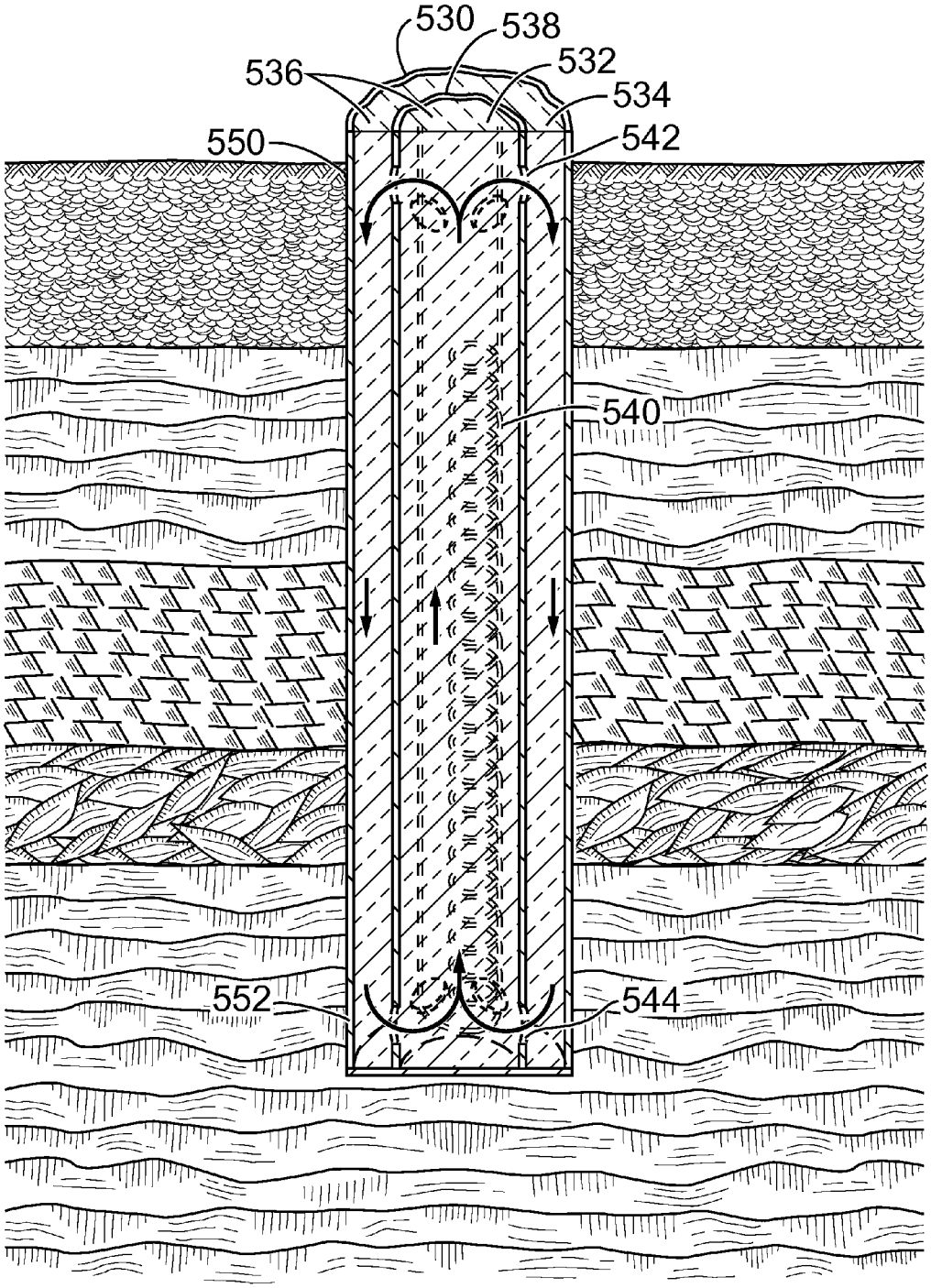
FIG. 14 is a schematic, not-to-scale, partial cutaway view of a down-hole apparatus for heating subterranean earth in accordance with various embodiments of the present invention.

Another modification of the present invention is shown in FIG. 14, which is similar to FIG. 1 with the exception of the following modifications. An inner core 532 and outer jacket 534 both contain molten heat transfer metal 536. A heating element 540 in the core 532 is immersed within and in direct contact with the heat transfer metal 536. Therefore, the heating element 540 must be electrically insulated from the heat transfer metal 536. An inner wall 538 includes openings 542 at the top 550 and openings 544 at the bottom 552 if the inner wall. During operation, heat transfer metal 536 in the core 532 will reach higher temperatures than the heat transfer metal 536 in jacket 534, driving convective circulation of the molten heat transfer metal 536 upward in the core 532 and downward in the jacket 534 as shown by the arrows, maximizing heat transfer from the heating element 540 to the well casing 530 and minimizing hot spots.

The skilled artisan will recognize that some of the embodiments of the present invention described above operate in a passive circulation mode, wherein the molten heat transfer metal moves only by convection in order to minimize hot spots. Other embodiments of the present invention described above operate in an active circulation mode, wherein the molten heat transfer metal moves primarily under force in order to minimize or eliminate hot spots.

The skilled artisan will further recognize that the "axial" supports described hereinabove for many of the embodiments of the present invention can be non-axial, and of any desired configuration that allows and/or promotes axial flow of the heat transfer metal.

In all of the embodiments of the present invention, well-casing can be made in connectible and/or detachable segments, each segment having a sealed jacket containing heat transfer metal in accordance with the present invention. Moreover, such segments can be made so that the jacket of each connected segment is in fluid communication with the jacket of the segment connected to either or both ends.

Many of the above described embodiments of the present invention can be installed with the heat transfer metal solidified, and later raised to the desired operating temperature above the melting point, but below the boiling point of the heat transfer metal. An advantage of the embodiments is that there are no moving parts except the molten heat transfer metal, and when the heat transfer metal is solidified, the entire apparatus is significantly resistant to damage, particularly from impacts and swelling of the geologic formations during heating.

The skilled artisan will recognize that, although the drawings illustrate vertically oriented apparatus, any of the embodiments of the present invention described hereinabove can be configured for non-vertical applications, including configurations with curves, bends, and/or angles.

While there has been shown and described what are at present considered the preferred embodiments of the invention, it will be obvious to those skilled in the art that various changes and modifications can be prepared therein without departing from the scope of the inventions defined by the appended claims.

What is claimed is:

1. Apparatus for efficient heating of subterranean earth, comprising:

a. a well-casing comprising an inner wall and an outer wall;

b. a heater disposed within said inner wall, said heater being operable within a preselected operating temperature range; and c. a heat transfer metal disposed within said outer wall and without said inner wall, said heat transfer metal characterized by a melting point temperature lower than said preselected operating temperature range, said heat transfer metal further characterized by a boiling point temperature higher than said preselected operating temperature range.

2. Apparatus in accordance with claim 1 wherein said beater comprises at least one heater selected from the group consisting of electrically resistive heating element and a combustor.

3. Apparatus in accordance with claim 1 wherein said apparatus is configured so that said heat transfer metal operates in a passive circulation mode.

4. Apparatus in accordance with claim 1 wherein said apparatus is configured so that said heat transfer metal operates in an active circulation mode.

5. Apparatus in accordance with claim 4 further comprising means for forcibly circulating said heat transfer metal.

6. Apparatus in accordance with claim 1 wherein said heat transfer metal comprises at least one metal selected from the group consisting of sodium, potassium, bismuth, lead, tin, antimony, and alloys of any of the foregoing.

7. A method of heating subterranean earth comprising:

a. disposing into a well: a well-casing comprising an inner wall and an outer wall; a heater disposed within said inner wall, said heater being operable within a preselected operating temperature range; and a heat transfer metal disposed within said outer wall and without said inner wall, said heat transfer metal characterized by a melting point temperature lower than said preselected operating temperature range, said heat transfer metal further characterized by a boiling point temperature higher than said preselected operating temperature range; and b. operating said heater within said preselected operating temperature range to raise the temperature of said heat transfer metal to at least one temperature within said preselected operating temperature range to transfer heat from said heater to the subterranean earth.

8. A method of heating subterranean earth in accordance with claim 7 wherein said heater comprises at least one heater selected from the group consisting of electrically resistive heating element and a combustor.

9. A method of heating subterranean earth in accordance with claim 7 wherein said heat transfer metal is operated in a passive circulation mode.

10. A method of heating subterranean earth in accordance with claim 7 wherein said heat transfer metal is operated in an active circulation mode.

11. A method of heating subterranean earth in accordance with claim 7 wherein said heat transfer metal comprises at least one metal selected from the group consisting of sodium, potassium, bismuth, lead, tin, antimony, and alloys of any of the foregoing.

* * * * *